United States Patent [19]

Lubbers

[11] 4,281,529

[45] Aug. 4, 1981

[54] METHOD OF MANUFACTURING A RESILIENT, SINGLE OR DOUBLE C-SHAPED RAIL CLAMP

[75] Inventor: Marius H. Lubbers, Wassenaar, Netherlands

[73] Assignee: Everts & van der Weyden Exploitatiemaatschappij Ewem N.V., The Hague, Netherlands

[21] Appl. No.: 40,870

[22] Filed: May 21, 1979

[30] Foreign Application Priority Data

Jul. 19, 1978 [NL] Netherlands ..... 7807737

[51] Int. Cl.[3] ..... B21D 7/00

[52] U.S. Cl. ..... 72/215; 72/306; 72/342

[58] Field of Search ..... 72/128, 215, 384, 386, 72/306, 316, 318, 319, 342; 29/16

[56] References Cited

U.S. PATENT DOCUMENTS

| | | | |
|---|---|---|---|
| 644,249 | 2/1900 | Keyes | 72/215 |
| 1,773,812 | 8/1930 | Fry | 72/215 |
| 2,202,016 | 5/1940 | McCutcheon | 72/215 |
| 4,053,107 | 10/1977 | Goderbauer | 238/349 |
| 4,061,005 | 12/1977 | Kawanami et al. | 72/128 |

*Primary Examiner*—Lowell A. Larson
*Attorney, Agent, or Firm*—John P. Snyder

[57] ABSTRACT

A method of manufacturing a resilient, C-shaped rail clamp wherein rod-shaped material is clamped tight at one end and starting from the clamped end the rod is deformed into the desired shape by a movement of a roller towards the free end while exerting local pressure.

7 Claims, 7 Drawing Figures

METHOD OF MANUFACTURING A RESILIENT, SINGLE OR DOUBLE C-SHAPED RAIL CLAMP

The invention relates to a method of manufacturing a resilient, single or double, C-shaped rail clamp. Hitherto such a rail clamp has been made from bar-shaped material whilst applying heat. The operation is carried out at a temperature of the order of magnitude of 1000° C. to 1150° C. This method is time-consuming and expensive.

The invention has for its object to manufacture such rail clamps at low costs. According to the invention this is achieved by clamping tight one end of a length of rod and by deforming the rod starting from the clamped end by a movement towards the free end under local pressure into the desired shape. Thus the clamped length of rod can be shaped into the desired form with the aid of a pressure roller moving along the rod. The pressure roller covers a path substantially corresponding to the desired shape of the clamp to be obtained. In order to obtain a double C-shaped clamp the starting material is also a rod clamped tight at one end, in contrast to the method hitherto employed, in which the operation started at the central portion, which was bent over at two spots at an angle of 90°, after which the bent-over parts were deformed into a C. It is possible to first form the two C's and to subsequently bent over the centre twice at an angle of 90° or to leave one end portion constantly in the clamped position and to cause the pressure roller to run along the whole path of the double C-shaped rail clamp. It is possible to move a heating element at a short distance ahead of the pressure roller.

BRIEF DESCRIPTION OF THE DRAWINGS

The invention will be set out more fully with reference to the drawings, wherein.

Figure 1:
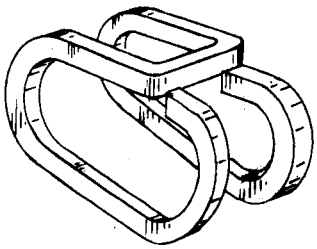
FIG. 1 is a perspective view of the finished product.
Figure 2:
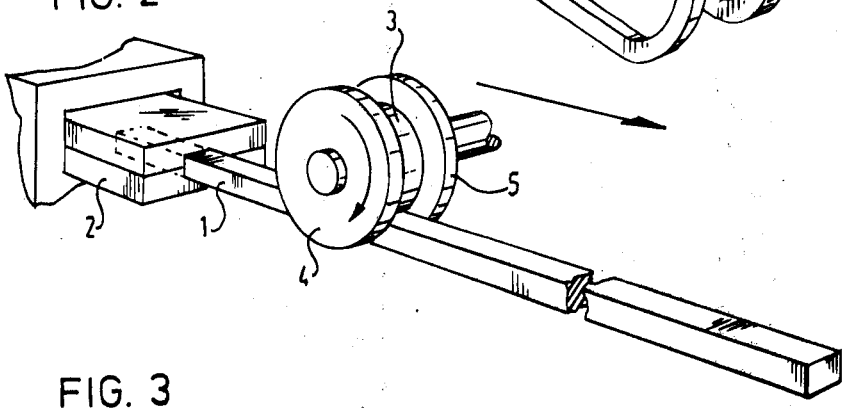
FIG. 2 is a perspective view illustrating a portion of the apparatus for forming the finished product.
Figure 3:
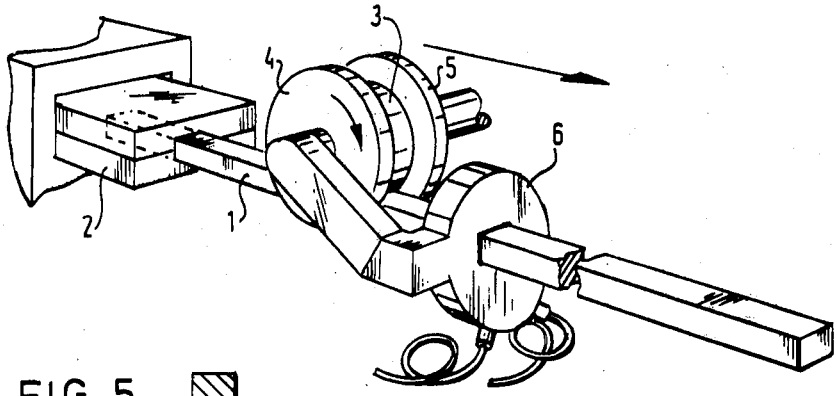
FIG. 3 is similar to FIG. 2 with additional heating apparatus.
Figure 5:
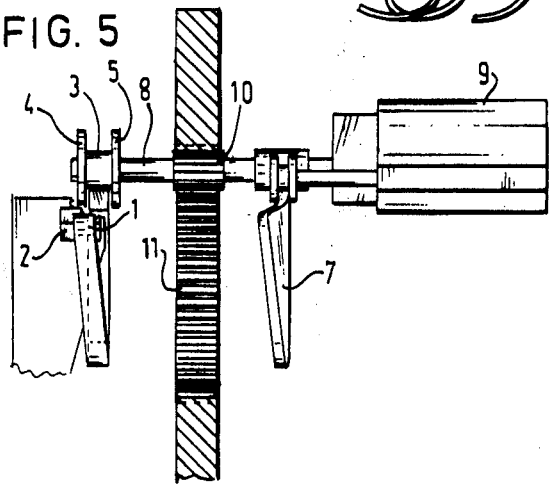
FIG. 5 is a sectional view of FIG. 4 taken through plane V—V illustrating the offset.
Figure 4:
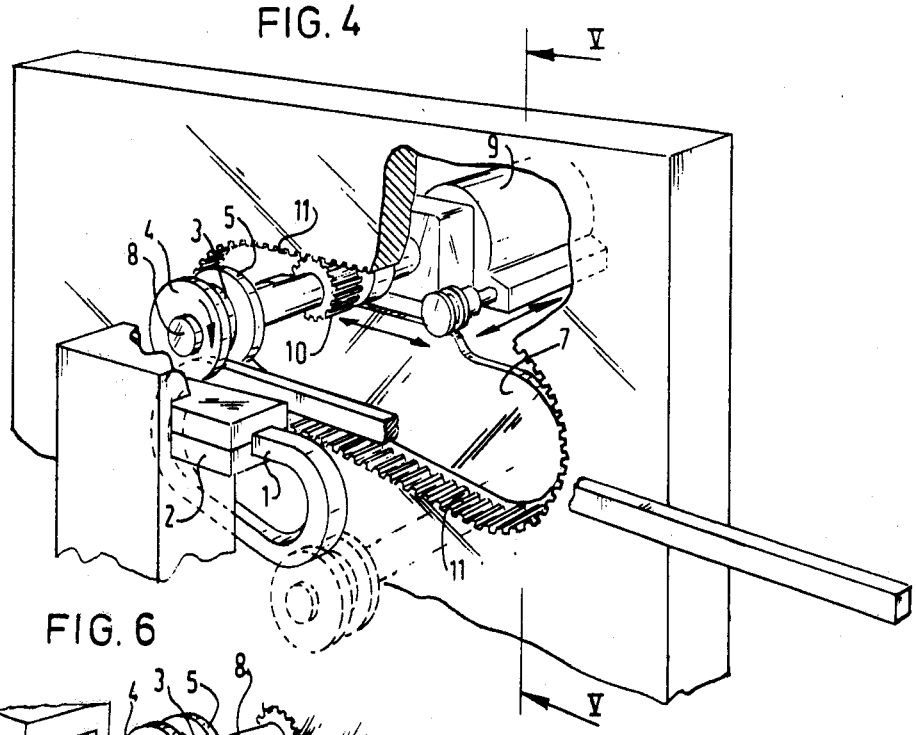
FIG. 4 is a perspective view, partially broken away, illustrating the apparatus forming the initial bends.
Figure 6:
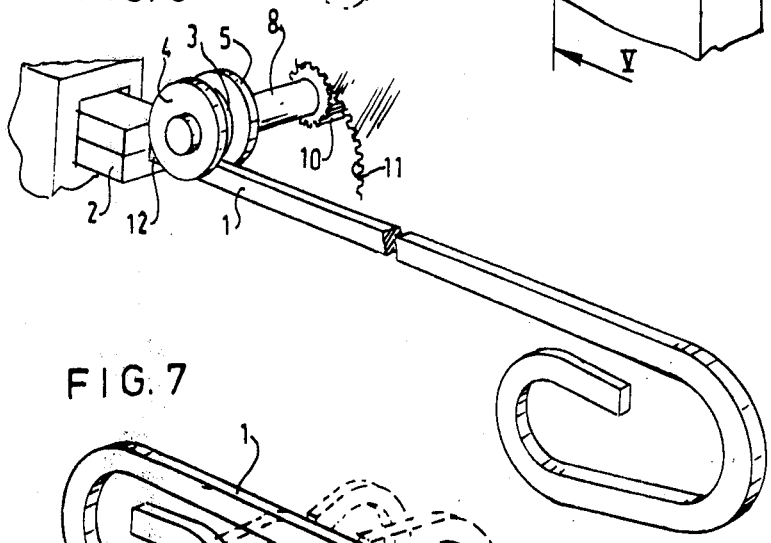
FIG. 6 is similar to FIG. 2 showing further bending after the initial bends are formed.
Figure 7:
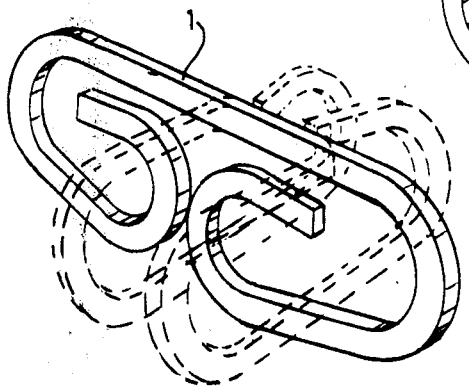
FIG. 7 is a perspective view illustrating the final bending operation.

The resilient, double C-shaped rail clamp shown in FIG. 1 is manufactured by clamping tight 2 one end of a length of rod material 1 (see FIG. 2) and by subsequently causing the pressure roller 3 provided with flanges 4 and 5, one on each side, to roll in the direction of the arrow along the rod. If desired, the roller 3 may be preceded by a heating disc 6 embracing the rod. The pressure roller covers a path (see FIG. 4) having substantially the shape of the C to be formed. The roller is rotatable about the shaft 8, is driven by the motor 9 and is guided along its path by the cam disc 7. During the movement along the path defined by the cam 7 the shaft 8 is rotated by the co-operation of the pinion 10 with the toothed rim 11. After one C is formed, the second C can be formed in the same manner after the central portion of the clamp to be formed is bent over twice. As an alternative (see FIG. 6) subsequent to the formation of one C, the other end 12 of the rod may be clamped tight to form a second C in a similar run as illustrated in FIG. 4. Then the resultant form (see FIG. 7) indicated by solid lines can be bent over at right angles in the central portion so that a double C-shaped, resilient clamp of FIG. 7 indicated by broken lines is obtained.

As an alternative, the clamped end portion may be passed in a direction of length through the clamping area. In this case the pressure roller will remain substantially stationary, viewed in the direction of length of the rod. A movement substantially perpendicular to the direction of length will be sufficient to form the C-shaped clamp.

What I claim is:

1. The method of making a resilient, C-shaped rail clamp, which comprises the steps of:

(a) fixing one end of an elongate bar to leave the remainder of the bar exposed; and (b) deforming said bar into C-shape by engaging one side of the bar with a roller while leaving the opposite side wholly free and travelling the roller through a closed path which begins and ends adjacent said fixed end of the bar.

2. The method as defined in claim 1 including the further steps of:

(c) freeing said one end of the bar and fixing the opposite end thereof; and (d) deforming said bar into a second C-shape by engaging said one side of the bar with said roller while leaving said opposite side of the bar wholly free and travelling said roller through said closed path.

3. The method as defined in claim 2 including the step of bending an intermediate portion of said bar in U-shape to provide said C-shapes in generally parallel, side-by-side relation.

4. The method as defined in any one of claims 1–3 including the step of laterally shifting said roller while it is travelled through a portion of said closed path whereby the end of said path is laterally displaced from the beginning of said path.

5. The method as defined in claim 3 including the step of laterally shifting said roller while it is travelled through the beginning portion of said closed path whereby the end of said path is laterally displaced from said beginning thereof, and bending an intermediate portion of the bar into U-shape such that said C-shaped portions lie in side-by-side generally parallel and spaced relation with the opposite ends thereof displaced toward each other.

6. The method as defined in any one of claims 1–3 or 5 including the steps of locally and progressively heating said bar ahead of said roller.

7. The method as defined in claim 4 including the steps of locally and progressively heating said bar ahead of said roller.

* * * * *